US009694587B2

(12) United States Patent
Shimomura et al.

(10) Patent No.: US 9,694,587 B2
(45) Date of Patent: Jul. 4, 2017

(54) INKJET PRINTING APPARATUS AND INK CARTRIDGE MOUNTING UNIT

(71) Applicant: SEIKO EPSON CORPORATION, Tokyo (JP)

(72) Inventors: Masaki Shimomura, Matsumoto (JP); Atsushi Takei, Chino (JP); Yoshihisa Saka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/063,017

(22) Filed: Mar. 7, 2016

(65) Prior Publication Data

US 2016/0271958 A1 Sep. 22, 2016

(30) Foreign Application Priority Data

Mar. 19, 2015 (JP) ..... 2015-056763

(51) Int. Cl.
*B41J 2/175* (2006.01)

(52) U.S. Cl.
CPC ..... *B41J 2/1752* (2013.01); *B41J 2/17509* (2013.01); *B41J 2/17546* (2013.01)

(58) Field of Classification Search
CPC .. B41J 2/17553; B41J 2/1752; B41J 2/17526; B41J 2/17566
See application file for complete search history.

(56) References Cited

U.S. PATENT DOCUMENTS 5,949,447 A * 9/1999 Arai ..... B41J 2/16517 347/23
7,150,520 B2 * 12/2006 Shinada ..... B41J 2/175 347/49
7,219,985 B2 * 5/2007 Shinada ..... D06M 13/44 347/50
7,360,858 B2 * 4/2008 Hayamizu ..... B41J 2/17566 347/19
7,681,982 B2 * 3/2010 Suzuki ..... B41J 2/16523 347/36
7,909,440 B2 3/2011 Kumagai et al.
7,934,792 B2 5/2011 Kumagai et al.
9,132,653 B2 * 9/2015 Takagi ..... B41J 2/1752
2008/0180496 A1 * 7/2008 Hattori ..... B41J 2/17513 347/86
2011/0310187 A1 * 12/2011 Kanbe ..... B41J 2/17513 347/86

FOREIGN PATENT DOCUMENTS

JP 2006-272874 A 10/2006

* cited by examiner

*Primary Examiner* — Stephen Meier
*Assistant Examiner* — John P Zimmerman
(74) *Attorney, Agent, or Firm* — Stroock & Stroock & Lavan LLP

(57) ABSTRACT

A mounting portion in which a first ink cartridge can be mounted, and a first mounting detection portion that can detect that the first ink cartridge is mounted in the mounting portion are included, and the first mounting detection portion can detect that a mounting unit in which a second ink cartridge can be mounted is mounted in the mounting portion.

12 Claims, 8 Drawing Sheets

INKJET PRINTING APPARATUS AND INK CARTRIDGE MOUNTING UNIT

Priority is claimed under 35 U.S.C. §119 to Japanese Application No. 2015-056763 filed on Mar. 19, 2015 which is hereby incorporated by reference in its entirety.

BACKGROUND

1. Technical Field

The present invention relates to an inkjet printing apparatus and an ink cartridge mounting unit connected to this apparatus.

2. Related Art

In the related art, an inkjet unit (inkjet printing apparatus) for performing printing using ink supplied from a cradle unit (ink cartridge mounting unit) is known (JP-A-2006-272874, for example).

That is to say, the inkjet unit and the cradle unit can be connected to each other. Ink is supplied from the cradle unit to the inkjet unit to which the cradle unit is connected.

Incidentally, the inkjet unit has a cartridge mounting portion (ink cartridge mounting portion), and an ink container (first ink cartridge) is mounted in the cartridge mounting portion. When an ink supply needle of the cradle unit is inserted into the ink container, ink is supplied from an ink tank (second ink cartridge) included in the cradle unit to the ink container.

Accordingly, a dedicated configuration is necessary to connect the cradle unit and the inkjet unit. That is to say, in order to perform printing using the inkjet unit, the ink container has to be mounted in the cartridge mounting portion. Furthermore, in order to connect the cradle unit to the inkjet unit, an ink injection opening into which the ink supply needle can be inserted has to be formed in the ink container. Accordingly, those containers other than dedicated ink containers cannot be mounted in the cartridge mounting portion.

This sort of problem is not limited to inkjet units to which ink is supplied from cradle units, and generally the same issue arises in inkjet printing apparatuses to which ink is supplied from ink cartridge mounting units and the ink cartridge mounting units connected to these apparatuses.

SUMMARY

An advantage of some aspects of the invention is to provide an inkjet printing apparatus that can perform printing using ink supplied from a plurality of types of ink cartridges, and an ink cartridge mounting unit connected to this apparatus.

Hereinafter, means for solving the above-described problem and advantageous effects thereof will be described.

In order to solve the above-described problem, an aspect of the invention is directed to an inkjet printing apparatus, including: an ink cartridge mounting portion in which a first ink cartridge can be mounted; and a mounting detection portion that can detect that the first ink cartridge is mounted in the ink cartridge mounting portion. The mounting detection portion can detect that an ink cartridge mounting unit in which a second ink cartridge can be mounted is mounted in the ink cartridge mounting portion.

With this configuration, the first ink cartridge or the ink cartridge mounting unit can be mounted in the ink cartridge mounting portion. Accordingly, when the first ink cartridge is mounted in the ink cartridge mounting portion, printing can be performed using the ink contained in the first ink cartridge. Furthermore, when the ink cartridge mounting unit is mounted in the ink cartridge mounting portion, printing can be performed using the ink contained in the second ink cartridge mounted in the ink cartridge mounting unit. Accordingly, it is possible to perform printing using ink supplied from a plurality of types of ink cartridges.

It is preferable that, by receiving, from the ink cartridge mounting unit mounted in the ink cartridge mounting portion, a signal indicating that the second ink cartridge is mounted in the ink cartridge mounting unit, the mounting detection portion can detect that the second ink cartridge is mounted in the ink cartridge mounting unit.

With this configuration, the mounting detection portion can easily detect that the second ink cartridge is mounted in the ink cartridge mounting unit, by receiving a signal indicating that the second ink cartridge is mounted, from the ink cartridge mounting unit.

It is preferable that the mounting detection portion can be electrically connected to an electrical connection portion provided in the ink cartridge mounting unit, and can detect that the second ink cartridge is mounted in the ink cartridge mounting unit when a terminal contact portion provided in the second ink cartridge is brought into contact with the electrical connection portion.

With this configuration, the mounting detection portion can be electrically connected to the electrical connection portion provided in the ink cartridge mounting unit, and, thus, the mounting detection portion can easily detect that the second ink cartridge is mounted in the ink cartridge mounting unit.

It is preferable that the ink cartridge mounting portion includes: an openable portion that is opened and closed when attaching or detaching the first ink cartridge to or from the ink cartridge mounting portion; and an open/closed detection portion that detects whether the openable portion is open or closed, and the mounting detection portion detects that the first ink cartridge is mounted in the ink cartridge mounting portion, based on a signal received from the open/closed detection portion.

With this configuration, the mounting detection portion causes the open/closed detection portion to detect whether the openable portion that is opened and closed when attaching or detaching the first ink cartridge to or from the ink cartridge mounting portion is open or closed. Accordingly, it is possible to easily detect that the first ink cartridge is mounted in the ink cartridge mounting portion.

It is preferable that the mounting detection portion detects that the second ink cartridge is mounted in the ink cartridge mounting unit, based on a signal received from an open/closed detection portion that detects whether an openable portion that is opened and closed when attaching or detaching the second ink cartridge to or from the ink cartridge mounting unit is open or closed.

With this configuration, the open/closed detection portion detects whether the openable portion that is opened and closed when attaching or detaching the second ink cartridge to or from the ink cartridge mounting unit is open or closed. Accordingly, it is possible to easily detect that the second ink cartridge is mounted in the ink cartridge mounting unit.

It is preferable that the inkjet printing apparatus further includes a control circuit portion that switches control modes, wherein the mounting detection portion further includes a first circuit portion that transmits a signal indicating what is mounted in the ink cartridge mounting portion, the control circuit portion performs control in a first control mode in a case of receiving a signal indicating that the first ink cartridge is mounted in the ink cartridge mounting portion, from the first circuit portion, and performs control in a second control mode in a case of receiving a signal indicating that the ink cartridge mounting unit is mounted in the ink cartridge mounting portion, from the first circuit portion, and receiving a signal indicating that the second ink cartridge is mounted in the ink cartridge mounting unit, from a second circuit portion included in the ink cartridge mounting unit.

With this configuration, the control circuit portion switches the control modes based on which of the first ink cartridge and the ink cartridge mounting unit in which the second ink cartridge is mounted is mounted in the ink cartridge mounting portion. Accordingly, it is possible to perform control in a control mode suitable for what is mounted in the ink cartridge mounting portion.

It is preferable that the inkjet printing apparatus further includes: a display device that displays an ink residual amount; and a control circuit portion that controls display on the display device, wherein the mounting detection portion further includes a first circuit portion that transmits a signal indicating what is mounted in the ink cartridge mounting portion, the control circuit portion displays a first residual amount display portion on the display device in a case of receiving a signal indicating that the first ink cartridge is mounted in the ink cartridge mounting portion, from the first circuit portion, and displays a second residual amount display portion on the display device in a case of receiving a signal indicating that the ink cartridge mounting unit is mounted in the ink cartridge mounting portion, from the first circuit portion, and receiving a signal indicating that the second ink cartridge is mounted in the ink cartridge mounting unit, from a second circuit portion included in the ink cartridge mounting unit.

With this configuration, the control circuit portion controls display on the display device based on which of the first ink cartridge and the ink cartridge mounting unit in which the second ink cartridge is mounted is mounted in the ink cartridge mounting portion. Accordingly, the display device can display the residual amount display portion suitable for what is mounted in the ink cartridge mounting portion.

It is preferable that the control circuit portion can be connected via the first circuit portion to the second circuit portion in a case where the ink cartridge mounting unit is mounted in the ink cartridge mounting portion.

The control circuit portion not directly related to printing operations is typically provided in an empty space inside the apparatus, and may be provided in a deep portion inside the apparatus. Accordingly, with this configuration, since the second circuit portion is connected to the first circuit portion, the wiring length can be made shorter compared with the case in which the second circuit portion is directly connected to the control circuit portion. Accordingly, the space for arranging the wiring can be prevented from increasing, and the size of the inkjet printing apparatus can be prevented from becoming large.

In order to solve the above-described problem, an aspect of the invention is further directed to an ink cartridge mounting unit in which an ink cartridge can be mounted and that can be connected to an inkjet printing apparatus, including a terminal contact portion that can transmit identification information when connected to an electrical connection portion provided in the inkjet printing apparatus.

With this configuration, when the terminal contact portion of the ink cartridge mounting unit is brought into contact with the electrical connection portion of the inkjet printing apparatus, the inkjet printing apparatus can detect that the ink cartridge mounting unit is connected to the inkjet printing apparatus. Accordingly, ink can be supplied not only from the ink cartridge directly mounted in the inkjet printing apparatus, but also from the ink cartridge mounted in the ink cartridge mounting unit. Accordingly, when the ink cartridge mounting unit is connected to the inkjet printing apparatus, the inkjet printing apparatus can perform printing using ink supplied from a plurality of types of ink cartridges.

It is preferable that the ink cartridge mounting unit further includes a circuit portion that can transmit a signal to a control circuit portion provided in the inkjet printing apparatus when the ink cartridge is mounted in the ink cartridge mounting unit.

With this configuration, when the ink cartridge is mounted in the ink cartridge mounting unit, the circuit portion transmits a signal. Accordingly, the inkjet printing apparatus can easily detect that the ink cartridge is mounted in the ink cartridge mounting unit.

It is preferable that the ink cartridge mounting unit further includes: a cartridge accommodation portion that can accommodate the ink cartridge; and an openable portion that is opened and closed when attaching or detaching the ink cartridge to or from the cartridge accommodation portion.

With this configuration, since the openable portion that is opened and closed when attaching or detaching the ink cartridge to or from the cartridge accommodation portion is provided, the ink cartridge accommodated in the cartridge accommodation portion can be easily replaced.

It is preferable that the ink cartridge mounting unit further includes a pump for supplying ink from the ink cartridge to the inkjet printing apparatus.

With this configuration, since the pump for supplying ink from the ink cartridge to the inkjet printing apparatus is provided, ink can be supplied to the inkjet printing apparatus regardless of the configuration of the inkjet printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of an inkjet printing apparatus and an ink cartridge mounting unit connected to this inkjet printing apparatus will be described with reference to the drawings.

Figure 1:
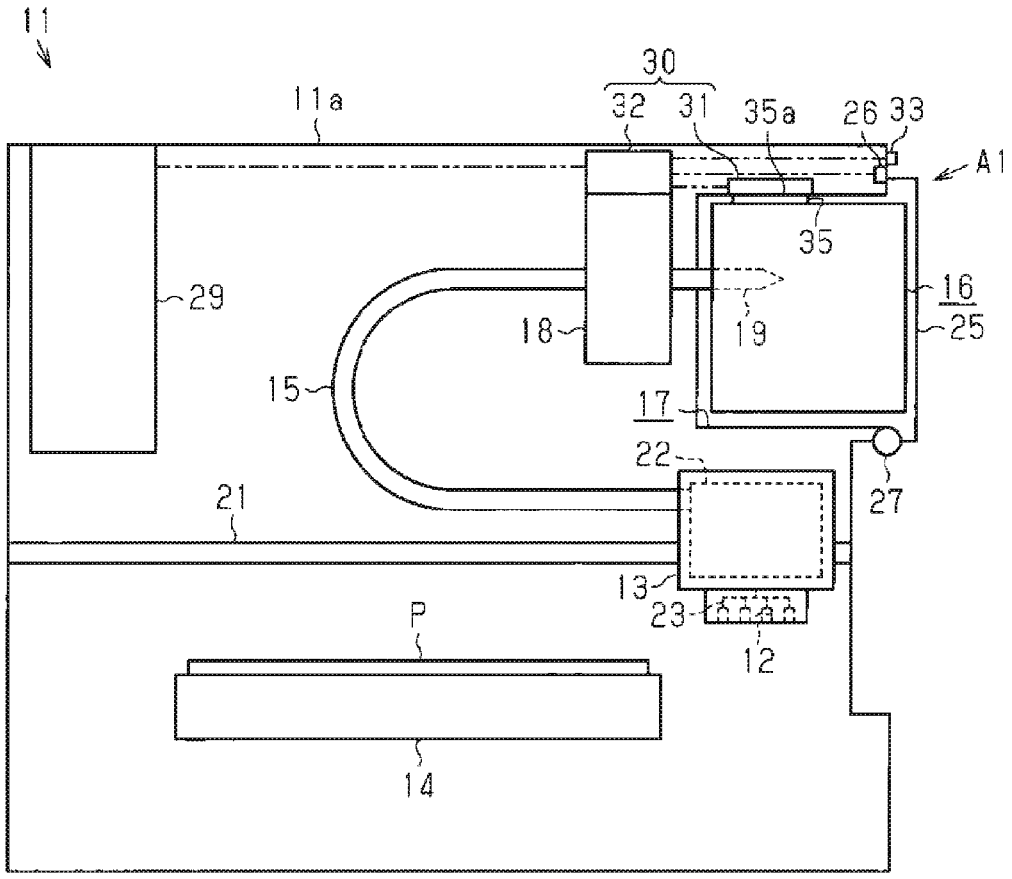
FIG. 1 is a schematic view of a first embodiment of a printing apparatus.

As shown in FIG. 1, an inkjet printing apparatus (hereinafter, referred to as a "printing apparatus") 11 of this embodiment includes a printing portion 13 having a plurality of nozzles 12 that eject ink onto a medium P, and a support surface 14 that supports the medium P. The printing apparatus 11 further includes a supply path 15 through which ink is supplied to the printing portion 13, and an ink cartridge mounting portion (hereinafter, referred to as a "mounting portion") 17 in which a first ink cartridge 16 can be mounted. Furthermore, a supply pump 18 is provided at a point on the supply path 15, and a supply needle 19 is provided at an upstream end of the supply path 15 positioned in the mounting portion 17.

The first ink cartridge 16 can be replaced, and is detachably mounted in the mounting portion 17. That is to say, when the first ink cartridge 16 containing ink is mounted in the mounting portion 17, the supply needle 19 is inserted into the first ink cartridge 16. Thus, the ink contained in the first ink cartridge 16 can be supplied via the supply needle 19 to the supply path 15.

The printing portion 13 of this embodiment can eject ink having a plurality of colors (e.g., four ink colors consisting of cyan, magenta, yellow, and black), and a plurality of (e.g., four) first ink cartridges 16 respectively containing different ink colors are mounted in the mounting portion 17. The first ink cartridges 16 of this embodiment are ink cartridges of the same type having substantially the same outer shape, although the types of ink contained therein are different from each other. The ink cartridges that can supply ink when directly mounted in the mounting portion 17 are taken as the first ink cartridges 16 of the same type regardless of their outer shapes. The printing apparatus 11 includes a plurality of supply needles 19 and a plurality of supply paths 15 respectively corresponding to the first ink cartridges 16.

The printing portion 13 can move back and forth in a scanning direction (left-right direction in FIG. 1) along a guide shaft 21. Accordingly, the supply path 15 connecting the movable printing portion 13 and the fixed mounting portion 17 is at least partially flexible, and is deflected in accordance with the movement of the printing portion 13.

The printing portion 13 further includes a pressure adjusting mechanism 22 that is in communication with a downstream end of the supply path 15, and a communication flow path 23 through which the pressure adjusting mechanism 22 and the nozzles 12 are in communication with each other. If the pressure in the communication flow path 23 becomes negative pressure that is lower than a preset threshold Pm ($Pm<0$) due to the ejection of ink from the nozzles 12 or the like, the pressure adjusting mechanism 22 allows the supply path 15 and the communication flow path 23 to be in communication with each other. On the other hand, if the pressure in the communication flow path 23 is equal to or greater than the threshold Pm, the pressure adjusting mechanism 22 restricts the communication between the supply path 15 and the communication flow path 23. Accordingly, even when pressure increases inside the supply path 15 due to the driving of the supply pump 18, ink is not supplied to the nozzles 12 in the state where the pressure adjusting mechanism 22 has restricted the communication between the supply path 15 and the communication flow path 23.

The mounting portion 17 includes a first openable portion 25 that is opened and closed when attaching or detaching the first ink cartridge 16 to or from the mounting portion 17, and a first open/closed detection portion 26 that detects whether the first openable portion 25 is open or closed. That is to say, the first openable portion 25 is provided so as to be turnable about a first shaft 27 between a closed position A1 shown in FIG. 1 and an open position B1 shown in FIG. 2. If the first openable portion 25 is positioned at the open position B1, the first ink cartridge 16 can be attached to the mounting portion 17 or detached from the mounting portion 17. Note that the first open/closed detection portion 26 of this embodiment is, for example, a photoelectric sensor having a light-emitting element and a light-receiving element, and detects whether or not the first openable portion 25 is positioned at the closed position A1 based on whether or not light is blocked by the first openable portion 25.

Next, the electrical configuration of the printing apparatus 11 will be described.

As shown in FIG. 1, the printing apparatus 11 includes a control circuit portion 29 that switches control modes, and a first mounting detection portion 30 that can detect that the first ink cartridge 16 is mounted in the mounting portion 17. The first mounting detection portion 30 includes a first electrical connection portion 31 provided in the mounting portion 17, and a first circuit portion 32 electrically connected to the first electrical connection portion 31.

The first electrical connection portion 31 is an electrical connection portion provided on the printing apparatus 11, and the same number of such first electrical connection portions 31 as the number of first ink cartridges 16 that can be mounted in the mounting portion 17 (e.g., four first electrical connection portions 31) are provided. Furthermore, the first circuit portion 32 is a circuit for transmitting a signal indicating what is mounted in the mounting portion 17, to the control circuit portion 29. The first circuit portion 32 is connected to the first open/closed detection portion 26, the control circuit portion 29, the first electrical connection portions 31, and a first connection terminal 33 provided on a casing 11*a* of the printing apparatus 11, via electrical wiring through which signals can be transmitted. Note that the first circuit portion 32 is disposed closer to the mounting portion 17 than to the control circuit portion 29, or closer to the first connection terminal 33 than to the control circuit portion 29.

The first ink cartridge 16 includes a first chip 35 such as a CSIC (customer service integrated circuit), for example. The first chip 35 includes a first terminal contact portion 35*a* that can be electrically connected to the first electrical connection portion 31 when in contact therewith. When connected to the first electrical connection portion 31, the first chip 35 transmits identification information via the first electrical connection portion 31 to the first circuit portion 32. The first circuit portion 32 transmits a signal indicating that the first ink cartridge 16 is mounted in the mounting portion 17, to the control circuit portion 29, based on the signal transmitted from the first chip 35.

Note that the identification information of the first ink cartridge 16 transmitted by the first chip 35 includes information indicating the amount of ink consumed. The information indicating the ink amount is rewritten as appropriate, as the ink supplied from the first ink cartridge 16 is consumed by the printing apparatus 11.

Next, an ink cartridge mounting unit that is mounted in the mounting portion 17 instead of the first ink cartridge 16 will be described. That is to say, not only the first ink cartridge 16, but also other ink cartridge mounting units can be mounted in the mounting portion 17 of the printing apparatus 11.

Figure 2:
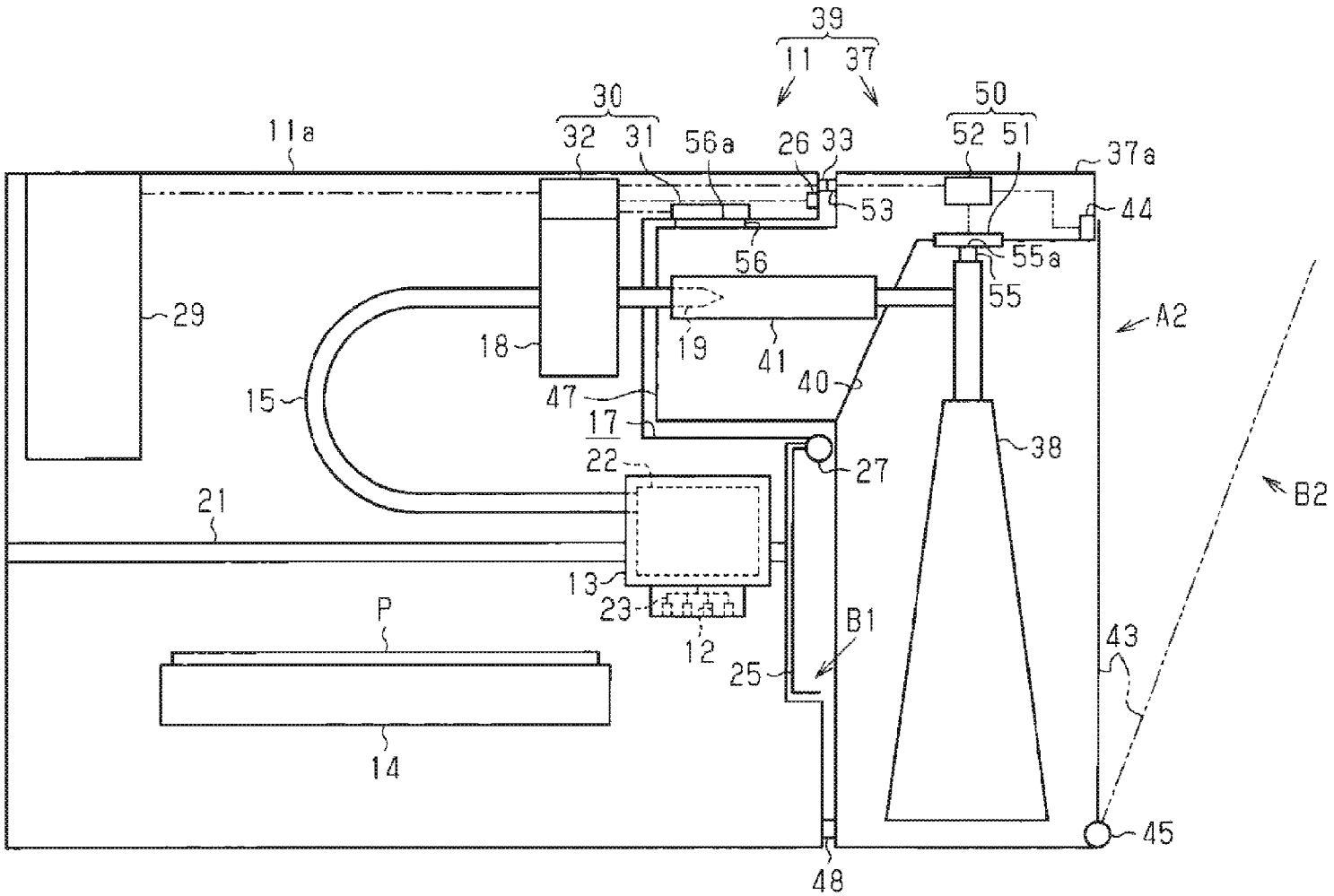
FIG. 2 is a schematic view of a printing apparatus to which a mounting unit is connected.

As shown in FIG. 2, an ink cartridge mounting unit (hereinafter, referred to as a "mounting unit") 37 is a unit in which a second ink cartridge 38 can be mounted and that can be connected to the printing apparatus 11. A printing apparatus unit 39 is configured by connecting the mounting unit 37 to the printing apparatus 11.

The second ink cartridge 38 is an ink cartridge of a different type having a shape, size, package, or the like that is different from that of the first ink cartridge 16, for example, and is capable of containing a larger amount of ink compared with the first ink cartridge.

The mounting unit 37 includes a cartridge accommodation portion 40 that can accommodate the second ink cartridge 38, and a connection portion 41 that connects the second ink cartridge 38 accommodated in the cartridge accommodation portion 40 and the supply needle 19 when the mounting unit 37 is connected to the printing apparatus 11. Note that a plurality of second ink cartridges 38 respectively containing different ink colors are mounted to the connection portion 41. That is to say, a plurality of second ink cartridges 38 (e.g., the same number of second ink cartridges 38 as the number of supply needles 19 provided in the printing apparatus 11) can be mounted to the connection portion 41 of this embodiment. The second ink cartridges 38 of this embodiment are ink cartridges of the same type having substantially the same outer shape, although the types of ink contained therein are different from each other. The ink cartridges that can be connected to the connection portion 41 of the mounting unit 37 are taken as the second ink cartridges 38 of the same type regardless of their outer shapes.

The mounting unit 37 includes a second openable portion 43 that is opened and closed when attaching or detaching the second ink cartridge 38 to or from the mounting unit 37, and a second open/closed detection portion 44 that detects whether the second openable portion 43 is open or closed. That is to say, the second openable portion 43 is opened and closed when attaching or detaching the second ink cartridge 38 to or from the cartridge accommodation portion 40. The second openable portion 43 is provided so as to be turnable about a second shaft 45 between a closed position A2 indicated by the solid line and an open position B2 indicated by the dashed double dotted line. If the second openable portion 43 is positioned at the open position B2, the second ink cartridge 38 can be attached to the connection portion 41 or detached from the connection portion 41. Note that the second open/closed detection portion 44 of this embodiment is, for example, a sensor similar to the first open/closed detection portion 26, and detects the second openable portion 43 positioned at the closed position A2.

The mounting unit 37 has a projecting portion 47 that can be mounted in the mounting portion 17. Note that a plurality of (e.g., four) second ink cartridges 38 are mounted in the mounting portion 17 of this embodiment. Accordingly, the projecting portion 47 has an outer shape obtained by coupling the second ink cartridges 38 mounted in the mounting portion 17 while maintaining a gap between adjacent second ink cartridges 38. The mounting unit 37 is connected to the printing apparatus 11 when the projecting portion 47 is mounted in the mounting portion 17.

Furthermore, the connection portion 41 is disposed inside the projecting portion 47, and, when the projecting portion 47 is mounted in the mounting portion 17, a plurality of (e.g., four) supply needles 19 are inserted into the connection portion 41. Thus, the ink contained in the second ink cartridges 38 mounted to the connection portion 41 can be supplied via the connection portion 41 and the supply needles 19 to the supply paths 15.

The mounting unit 37 further includes an engagement portion 48 that can be engaged with, for example, a bar-like lock mechanism (not shown) provided on the printing apparatus 11 when connected to the printing apparatus 11. That is to say, when the lock mechanism and the engagement portion 48 are engaged with each other, the mounting unit 37 is prevented from being detached from the printing apparatus 11. On the other hand, when the lock mechanism and the engagement portion 48 are not engaged with each other, the mounting unit 37 can be detached from the printing apparatus 11.

Next, the electrical configuration of the mounting unit 37 will be described.

As shown in FIG. 2, the mounting unit 37 includes a second mounting detection portion 50 that detects that the second ink cartridge 38 is connected to the connection portion 41. The second mounting detection portion 50 includes a second electrical connection portion 51 provided on the cartridge accommodation portion 40, and a second circuit portion 52 electrically connected to the second electrical connection portion 51.

The second electrical connection portion 51 is an electrical connection portion provided in the mounting unit 37, and the same number of such second electrical connection portions 51 as the number of second ink cartridges 38 that can be mounted to the connection portion 41 (e.g., four second electrical connection portions 51) are provided. Furthermore, the second circuit portion 52 is a circuit for transmitting a signal indicating that the second ink cartridge 38 is accommodated in the cartridge accommodation portion 40 and is connected to the connection portion 41, to the printing apparatus 11. The second circuit portion 52 is connected to the second open/closed detection portion 44, the second electrical connection portions 51, and a second connection terminal 53 provided on a casing 37*a* of the mounting unit 37, via electrical wiring through which signals can be transmitted.

The second connection terminal 53 is provided at a position where connection to the first connection terminal 33 of the printing apparatus 11 is established when the mounting unit 37 is connected to the printing apparatus 11. Accordingly, the first mounting detection portion 30 of the printing apparatus 11 can be electrically connected via the first connection terminal 33 and the second connection terminal 53 to the second electrical connection portion 51 provided in the mounting unit 37. Furthermore, the control circuit portion 29 can be connected via the first circuit portion 32 to the second circuit portion 52 when the mounting unit 37 is mounted in the mounting portion 17.

The second ink cartridge 38 includes a second chip 55 such as a CSIC, for example. The second chip 55 includes a second terminal contact portion 55*a* that can be electrically connected to the second electrical connection portion 51 provided on the mounting unit 37, when in contact with the second electrical connection portion 51. That is to say, when the second terminal contact portion 55*a* is connected to the second electrical connection portion 51, the second chip 55 transmits identification information via the second electrical connection portion 51 to the second circuit portion 52.

The second circuit portion 52 transmits a signal indicating that the second ink cartridge 38 is mounted in the mounting unit 37, to the first circuit portion 32, based on the signal transmitted from the second chip 55. The first circuit portion 32 transmits this signal to the control circuit portion 29. That is to say, the second circuit portion 52 can transmit a signal via the first circuit portion 32 to the control circuit portion 29 when the second ink cartridge 38 is mounted in the mounting unit 37.

Meanwhile, the first mounting detection portion 30 provided in the printing apparatus 11 can detect that the second ink cartridge 38 is mounted in the mounting unit 37 when the second terminal contact portion 55*a* provided on the second ink cartridge 38 is brought into contact with the second electrical connection portion 51. That is to say, the first mounting detection portion 30 receives a signal indicating that the second ink cartridge 38 is mounted in the mounting unit 37, from the mounting unit 37 mounted in the mounting portion 17. Then, the first mounting detection portion 30 detects that the second ink cartridge 38 is mounted in the mounting unit 37 and thus ink can be supplied.

Note that the identification information of the second ink cartridge 38 transmitted by the second chip 55 includes information indicating the amount of ink consumed. The information indicating the ink amount is rewritten as appropriate, as the ink supplied from the second ink cartridge 38 is consumed by the printing apparatus 11.

Furthermore, the projecting portion 47 includes a third chip 56 such as a CSIC, for example. The third chip 56 includes a third terminal contact portion 56*a* that can transmit identification information when connected to at least one first electrical connection portion 31 provided on the printing apparatus 11. That is to say, when the third terminal contact portion 56*a* is brought into contact with the first electrical connection portion 31, the third chip 56 transmits identification information via the first electrical connection portion 31 to the first circuit portion 32. The first circuit portion 32 transmits a signal indicating that the mounting unit 37 is mounted in the mounting portion 17, to the control circuit portion 29, based on the identification information transmitted from the third chip 56. Accordingly, the first mounting detection portion 30 provided in the printing apparatus 11 can detect that the mounting unit 37 in which the second ink cartridge 38 can be mounted is mounted in the mounting portion 17.

Next, a mode selection routine in which the control circuit portion 29 selects control modes will be described with reference to the flowchart shown in FIG. 3.

Note that this mode selection routine is performed at the time when the first ink cartridge 16 is detached from the mounting portion 17 or at the time when the second ink cartridge 38 is detached from the connection portion 41.

Figure 3:
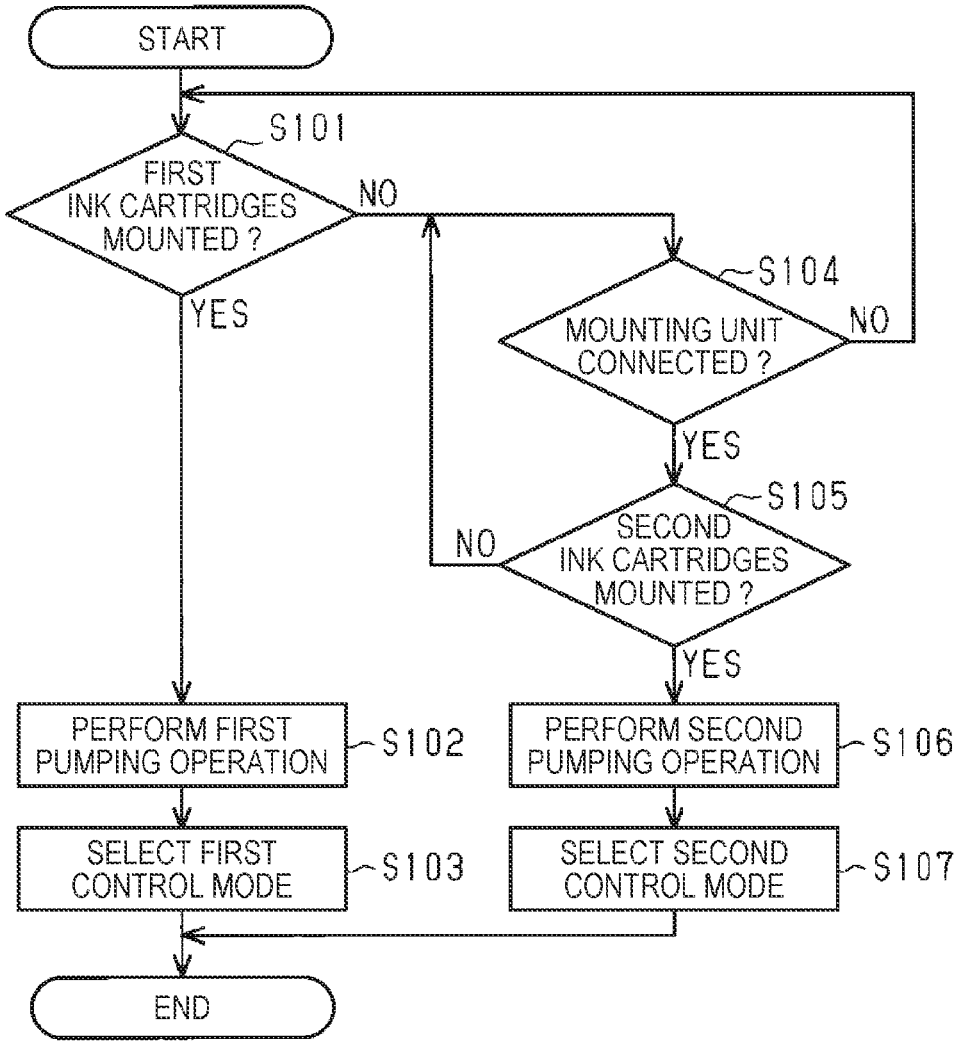
FIG. 3 is a flowchart showing a mode selection routine.

As shown in FIG. 3, in step S101, the control circuit portion 29 determines whether or not the first ink cartridges 16 are mounted in the mounting portion 17. If all first ink cartridges 16 are mounted in the mounting portion 17 (step S101: YES), in step S102, the control circuit portion 29 drives the supply pump 18 to perform a first pumping operation. Subsequently, in step S103, the control circuit portion 29 selects a first control mode, and ends the mode selection routine.

On the other hand, in step S101, if at least one first ink cartridge 16 is not mounted in the mounting portion 17 (step S101: NO), in step S104, the control circuit portion 29 determines whether or not the mounting unit 37 is mounted in the mounting portion 17. Then, if the mounting unit 37 is not mounted in the mounting portion 17 (step S104: NO), the control circuit portion 29 shifts the procedure to step S101.

If the mounting unit 37 is mounted in the mounting portion 17 (step S104: YES), in step S105, the control circuit portion 29 determines whether or not all second ink cartridges 38 are mounted to the connection portion 41. If all second ink cartridges 38 are not mounted to the connection portion 41 (step S105: NO), the control circuit portion 29 shifts the procedure to step S104.

If all second ink cartridges 38 are mounted to the connection portion 41 (step S105: YES), in step S106, the control circuit portion 29 drives the supply pump 18 to perform a second pumping operation. Subsequently, in step S107, the control circuit portion 29 selects a second control mode, and ends the mode selection routine. The control modes selected in steps S103 and S107 are stored in a non-volatile storage portion (not shown), and are maintained even after the power is turned off.

Next, a residual amount display routine in which the control circuit portion 29 displays the residual amount of ink will be described with reference to the flowchart shown in FIG. 4.

Note that this residual amount display routine is performed after the mode selection routine is performed, when the power is turned on, or when ink is consumed in printing or cleaning.

Figure 4:
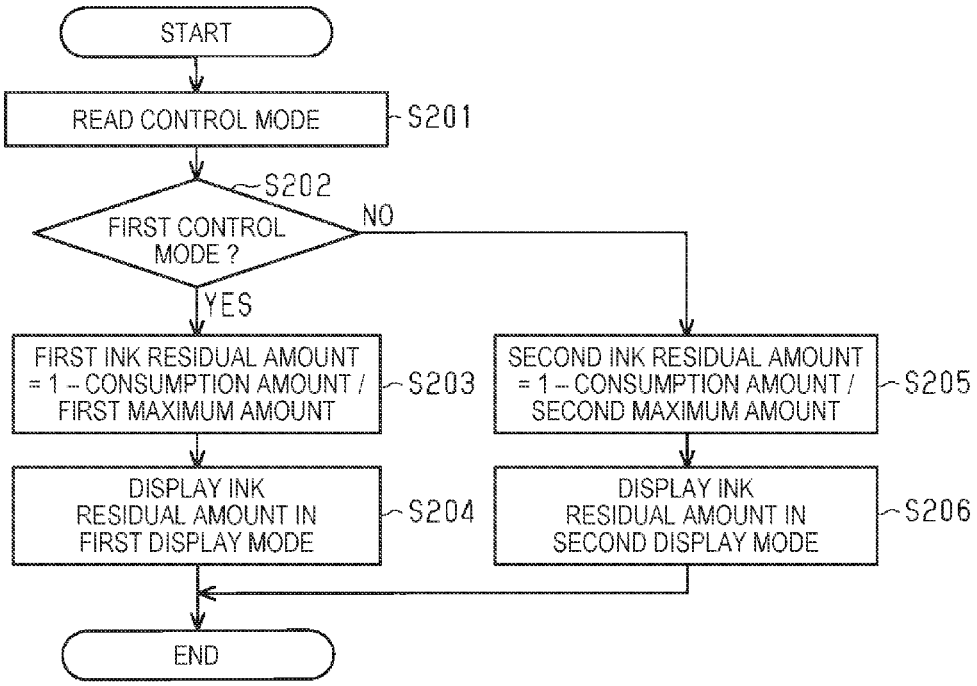
FIG. 4 is a flowchart showing a residual amount display routine.

As shown in FIG. 4, in step S201, the control circuit portion 29 reads the control mode selected in the mode selection routine and stored in the storage portion, and, in step S202, determines the read control mode. That is to say, if the first control mode is read (step S202: YES), in step S203, the control circuit portion 29 calculates a first ink residual amount based on a first maximum amount, which is the amount that can be contained in the first ink cartridge 16. Specifically, the control circuit portion 29 divides the consumption amount stored in the first chip 35 by the first maximum amount, and subtracts the thus obtained quotient from 1, thereby calculating a proportion of the consumption amount with respect to the first maximum amount, as a first ink residual amount. Note that the control circuit portion 29 calculates a first ink residual amount for each first ink cartridge 16. Subsequently, in step S204, the control circuit portion 29 displays the calculated first ink residual amount in a first display mode on a display device (see FIG. 5) 58 included in the printing apparatus 11, and ends the residual amount display routine.

On the other hand, if the control mode read in step S201 is the second control mode (step S202: NO), in step S205, the control circuit portion 29 calculates a second ink residual amount based on a second maximum amount, which is the amount that can be contained in the second ink cartridge 38. Specifically, the control circuit portion 29 divides the consumption amount stored in the second chip 55 by the second maximum amount, and subtracts the thus obtained quotient from 1, thereby calculating a proportion of the consumption amount with respect to the second maximum amount, as the second ink residual amount. Note that the control circuit portion 29 calculates a second ink residual amount for each second ink cartridge 38. Subsequently, in step S206, the control circuit portion 29 displays the calculated second ink residual amount in a second display mode on the display device (see FIG. 6) 58 included in the printing apparatus 11, and ends the residual amount display routine.

Next, the actions performed when mounting the first ink cartridge 16 in the mounting portion 17 and when mounting the mounting unit 37 therein will be described.

When mounting the first ink cartridge 16 in the mounting portion 17, the first ink cartridge 16 is mounted in the mounting portion 17, in a state where the first openable portion 25 is positioned at the open position B1. Thereafter, the first openable portion 25 is moved by the user to the closed position A1. Then, when the first ink cartridge 16 is mounted in the mounting portion 17, the control circuit portion 29 receives a signal indicating that the first ink cartridge 16 is mounted in the mounting portion 17, from the first circuit portion 32, and causes the supply pump 18 to perform the first pumping operation. Moreover, the control circuit portion 29 performs the control in the first control mode.

Note that the first pumping operation refers to an operation in which the amount of ink sucked from the first ink cartridge 16 is smaller than that in the second pumping operation. If the supply pump 18 performs the first pumping operation, negative pressure is applied to the nozzles 12 and the communication flow path 23 in a state where the nozzles 12 are covered by unshown caps. Thus, the pressure adjusting mechanism 22 allows the supply path 15 and the communication flow path 23 to be in communication with each other, so that the ink contained in the first ink cartridge 16 is supplied toward the printing portion 13 due to the application of pressure from the supply pump 18, so that the supply path 15 and the printing portion 13 are filled with the ink.

On the other hand, when mounting the mounting unit 37 in the mounting portion 17, the mounting unit 37 is mounted in the mounting portion 17, in a state where the first openable portion 25 is positioned at the open position B1. Furthermore, in the mounting unit 37, the second ink cartridge 38 is mounted to the connection portion 41, in a state where the second openable portion 43 is positioned at the open position B2. Thereafter, while the first openable portion 25 is kept at the open position B1, the second openable portion 43 is moved by the user to the closed position A2. Then, if the control circuit portion 29 receives a signal indicating that the mounting unit 37 is mounted in the mounting portion 17, from the first circuit portion 32, and receives a signal indicating that the second ink cartridge 38 is mounted in the mounting unit 37, from the second circuit portion 52, the control circuit portion 29 causes the supply pump 18 to perform the second pumping operation. Moreover, the control circuit portion 29 performs the control in the second control mode.

Note that the second pumping operation refers to an operation in which the amount of ink sucked from the second ink cartridge 38 is larger than that in the first pumping operation. If the supply pump 18 performs the second pumping operation, negative pressure is applied to the nozzles 12 and the communication flow path 23 as in the case of the first pumping operation. Accordingly, the ink contained in the second ink cartridge 38 is supplied toward the printing portion 13 due to the application of pressure from the supply pump 18, so that the connection portion 41, the supply path 15, and the printing portion 13 are filled with the ink.

Figure 5:
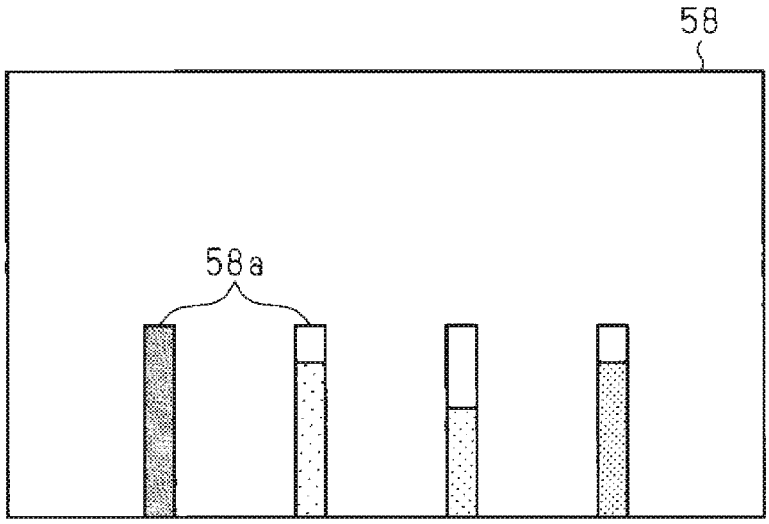
FIG. 5 is a schematic view of a display device displaying ink residual amounts in a first display mode.

As shown in FIG. 5, in the first control mode, the control circuit portion 29 displays the same number of first residual amount display portions 58*a* as the number of first ink cartridges 16 that can be mounted in the mounting portion 17 (e.g., four first residual amount display portions 58*a*) on the display device 58.

Figure 6:
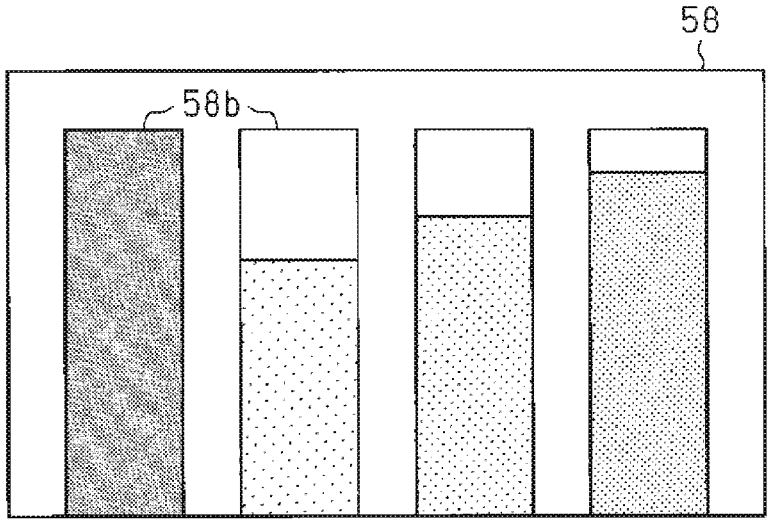
FIG. 6 is a schematic view of the display device displaying ink residual amounts in a second display mode.

Furthermore, as shown in FIG. 6, in the second control mode, the control circuit portion 29 displays the same number of second residual amount display portions 58*b* as the number of first residual amount display portions 58*a* (e.g., four second residual amount display portions 58*b*) on the display device 58.

That is to say, as shown in FIGS. 5 and 6, the display device 58 displays a difference between the amounts of ink contained in the first ink cartridges 16 and the second ink cartridges 38, as differences between the areas of the first residual amount display portions 58*a* and the second residual amount display portions 58*b*. That is to say, the second residual amount display portions 58*b* are longer, wider, and larger than the first residual amount display portions 58*a*.

The first residual amount display portions 58*a* display the first ink residual amounts of the respectively corresponding first ink cartridges 16. That is to say, the state in which no ink in each first ink cartridge 16 has been consumed and ink at the maximum capacity is contained therein is taken as 1, and, in this case, the first residual amount display portion 58*a* is displayed with an area thereof entirely colored. Then, after ink is consumed, the first residual amount display portion 58*a* is displayed with a lower area thereof colored based on the proportion of the consumption amount calculated as the first ink residual amount.

On the other hand, the second residual amount display portions 58*b* display the second ink residual amounts of the respectively corresponding second ink cartridges 38. That is to say, the state in which no ink in each second ink cartridge 38 has been consumed and ink at the maximum capacity is contained therein is taken as 1, and, in this case, the second residual amount display portion 58*b* is displayed with an area thereof entirely colored. Then, after ink is consumed, the second residual amount display portion 58*b* is displayed with a lower area thereof colored based on the proportion of the consumption amount calculated as the second ink residual amount.

Next, the positions of the first openable portion 25 and the second openable portion 43 during printing will be described.

In the first control mode, the control circuit portion 29 causes the printing portion 13 to perform printing when the first openable portion 25 is positioned at the closed position A1. The control circuit portion 29 stops printing when the first openable portion 25 is moved from the closed position A1.

In the second control mode, the control circuit portion 29 deactivates the first open/closed detection portion 26. That is to say, the detection result of the first open/closed detection portion 26 is not used in the control by the control circuit portion 29. The control circuit portion 29 causes the printing portion 13 to perform printing when the second openable portion 43 is positioned at the closed position A2, and stops printing when the second openable portion 43 is moved from the closed position A2.

According to the first embodiment described above, the following effects can be obtained.

(1) The first ink cartridge 16 or the mounting unit 37 can be mounted in the mounting portion 17. Accordingly, when the first ink cartridge 16 is mounted in the mounting portion 17, printing can be performed using the ink contained in the first ink cartridge 16. Furthermore, when the mounting unit 37 is mounted in the mounting portion 17, printing can be performed using the ink contained in the second ink cartridge 38 mounted in the mounting unit 37. Accordingly, it is possible to perform printing using ink supplied from a plurality of types of ink cartridges.

(2) The first mounting detection portion 30 can easily detect that the second ink cartridge 38 is mounted in the mounting unit 37, by receiving a signal indicating that the second ink cartridge 38 is mounted, from the mounting unit 37.

(3) The first mounting detection portion 30 can be electrically connected to the second electrical connection portion 51 provided in the mounting unit 37, and, thus, the first mounting detection portion 30 can easily detect that the second ink cartridge 38 is mounted in the mounting unit 37.

(4) The control circuit portion 29 switches the control modes based on which of the first ink cartridge 16 and the mounting unit 37 in which the second ink cartridge 38 is mounted is mounted in the mounting portion 17. Accordingly, it is possible to perform control in a control mode suitable for what is mounted in the mounting portion 17.

(5) The control circuit portion 29 controls display on the display device 58 based on which of the first ink cartridge 16 and the mounting unit 37 in which the second ink cartridge 38 is mounted is mounted in the mounting portion 17. Accordingly, the display device 58 can display the residual amount display portion suitable for what is mounted in the mounting portion 17.

(6) The control circuit portion 29 not directly related to printing operations is typically provided in an empty space inside the apparatus, and may be provided in a deep portion inside the apparatus. Accordingly, since the second circuit portion 52 is connected to the first circuit portion 32, the wiring length can be made shorter compared with the case in which the second circuit portion 52 is directly connected to the control circuit portion 29. Accordingly, the space for arranging the wiring can be prevented from increasing, and the size of the printing apparatus 11 can be prevented from becoming large.

(7) When the third terminal contact portion 56*a* of the mounting unit 37 is brought into contact with the first electrical connection portion 31 of the printing apparatus 11, the printing apparatus 11 can detect that the mounting unit 37 is connected to the printing apparatus 11. Accordingly, ink can be supplied not only from the first ink cartridge 16 directly mounted in the printing apparatus 11, but also from the second ink cartridge 38 mounted in the mounting unit 37. Accordingly, when the mounting unit 37 is connected to the printing apparatus 11, the printing apparatus 11 can perform printing using ink supplied from a plurality of types of ink cartridges.

(8) When the second ink cartridge 38 is mounted in the mounting unit 37, the second circuit portion 52 transmits a signal. Accordingly, the printing apparatus 11 can easily detect that the second ink cartridge 38 is mounted in the mounting unit 37.

(9) Since the second openable portion 43 that is opened and closed when attaching or detaching the second ink cartridge 38 to or from the cartridge accommodation portion 40 is provided, the second ink cartridge 38 accommodated in the cartridge accommodation portion 40 can be easily replaced.

Second Embodiment

Next, a second embodiment of an inkjet printing apparatus will be described with reference to the drawings. The second embodiment is different from the first embodiment in that the mounting portion in which the ink cartridge is mounted is movable. The other aspects of the configuration are substantially the same as those of the first embodiment, and, thus, the same constituent elements are denoted by the same reference numerals, and redundant description thereof has been omitted.

Figure 7:
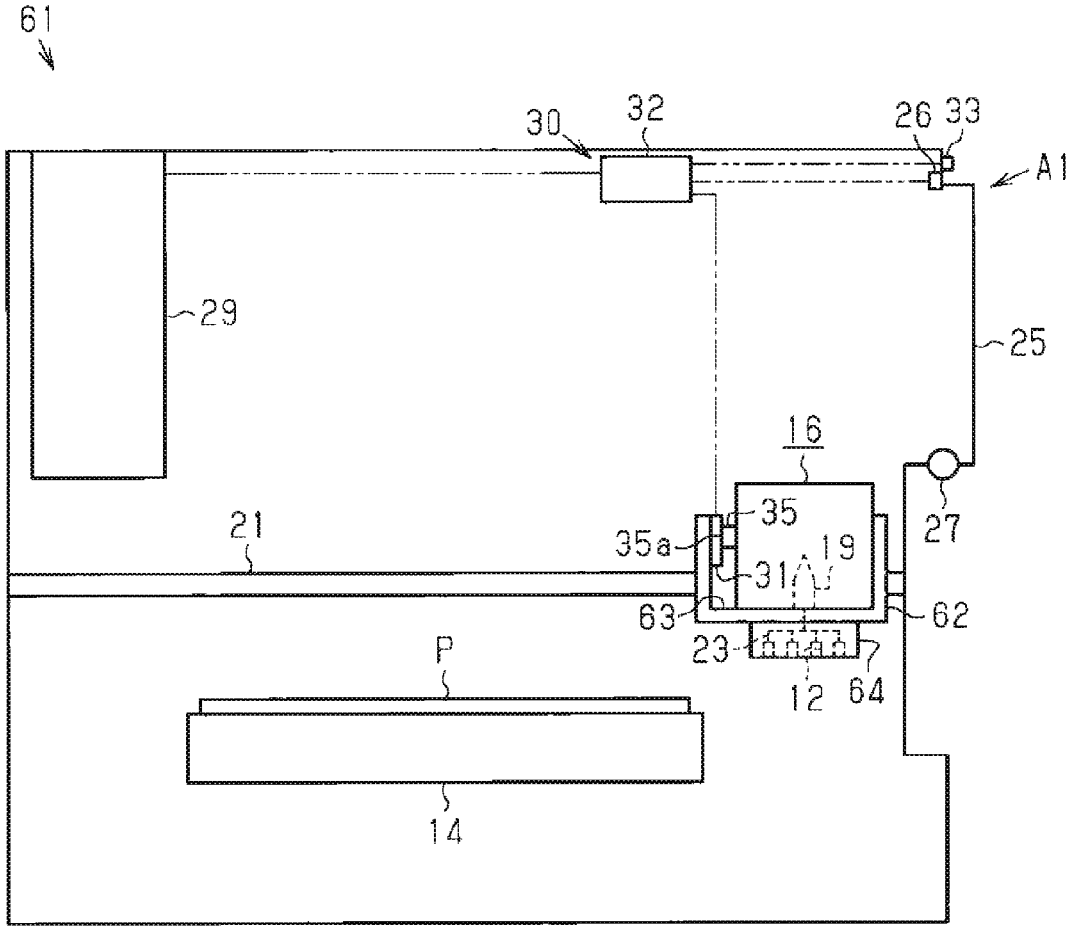
FIG. 7 is a schematic view of a second embodiment of a printing apparatus.

As shown in FIG. 7, an inkjet printing apparatus (hereinafter, referred to as a "printing apparatus") 61 includes a carriage 62 that can move back and forth in a scanning direction (left-right direction in FIG. 7) along the guide shaft 21. An ink cartridge mounting portion (hereinafter, referred to as a "mounting portion") 63 in which at least one (e.g., four) first ink cartridge 16 can be mounted is provided on the upper portion of the carriage 62, and a print head 64 having the nozzles 12 is provided on the lower portion of the carriage 62. That is to say, the printing apparatus 61 of this embodiment is a so-called on-carriage apparatus in which the mounting portion 63 and the print head 64 move together with the carriage 62.

The first ink cartridge 16 can be replaced, and is detachably mounted in the mounting portion 63. When the first ink cartridge 16 containing ink is mounted in the mounting portion 63, the supply needle 19 is inserted into the first ink cartridge 16. Thus, the ink contained in the first ink cartridge 16 can be supplied via the supply needle 19 and the communication flow path 23 to the nozzles 12.

The first electrical connection portion 31 is provided on the mounting portion 63, and can be in contact with the first terminal contact portion 35*a* of the first ink cartridge 16 mounted in the mounting portion 63. That is to say, the first electrical connection portion 31 moves in accordance with the movement of the carriage 62.

Figure 8:
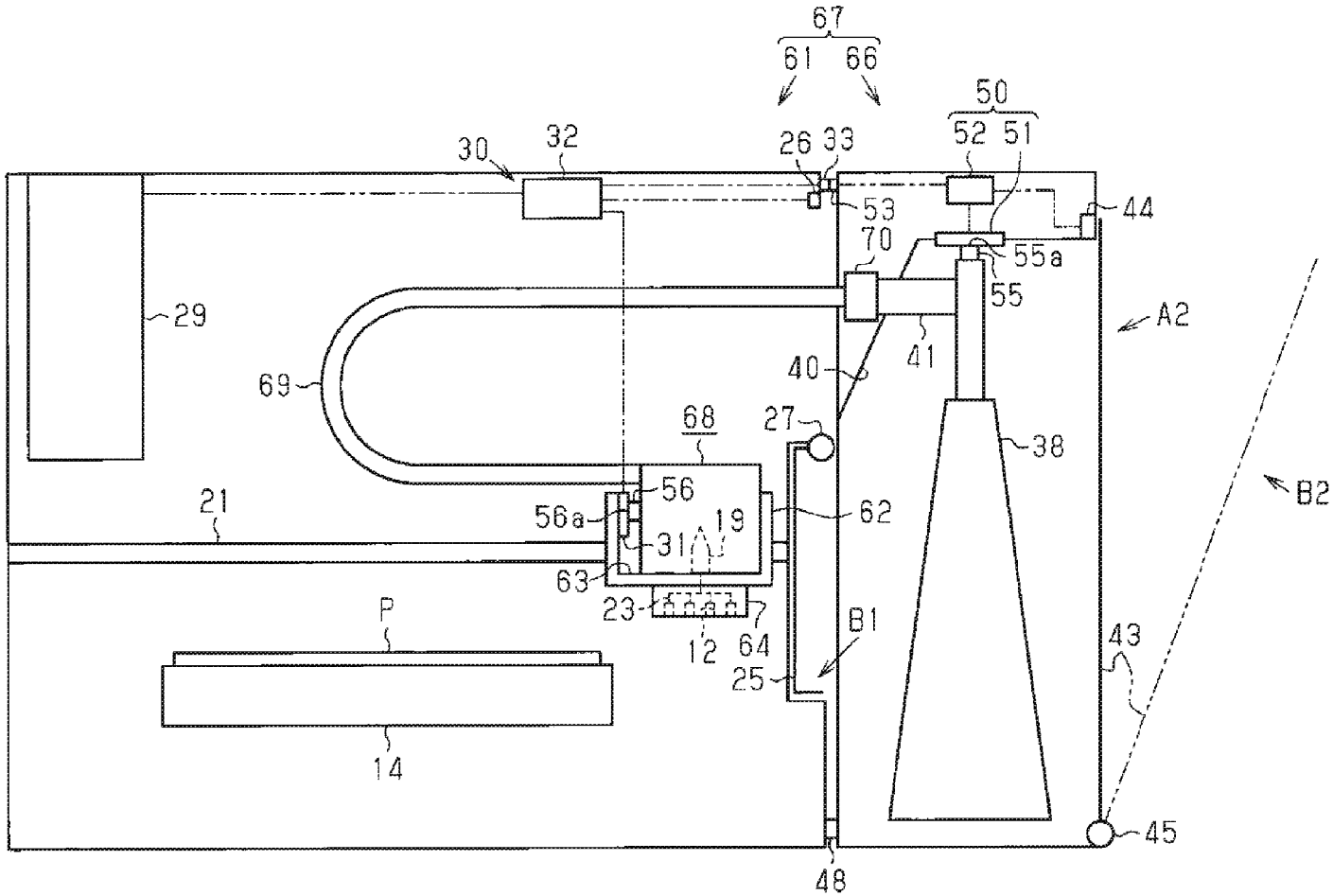
FIG. 8 is a schematic view of a printing apparatus to which a mounting unit is connected.

As shown in FIG. 8, not only the first ink cartridge 16, but also an ink cartridge mounting unit (hereinafter, referred to as a "mounting unit") 66 can be mounted in the mounting portion 63 of the printing apparatus 61. A printing apparatus unit 67 is configured by mounting the mounting unit 66 in the printing apparatus 61.

The mounting unit 66 includes a mounting member 68 that can be mounted in the mounting portion 63, and a supply tube 69 through which ink is supplied to the mounting member 68. Furthermore, a pump 70 for supplying ink from the second ink cartridge 38 to the printing apparatus 61 is provided between the supply tube 69 and the connection portion 41. Note that the same number of such supply tubes 69 and mounting members 68 as the number of first ink cartridges 16 that can be mounted in the mounting portion 63 (e.g., four supply tubes 69 and four mounting members 68) are provided. The mounting member 68 is provided with the third chip 56 having the third terminal contact portion 56*a* that can be in contact with the first electrical connection portion 31, when mounted in the mounting portion 63.

Next, a mode selection routine in which the control circuit portion 29 selects control modes will be described with reference to the flowchart shown in FIG. 9.

Note that this mode selection routine is performed at the time when the first ink cartridge 16 is detached from the mounting portion 63 or at the time when the second ink cartridge 38 is detached from the connection portion 41.

Figure 9:
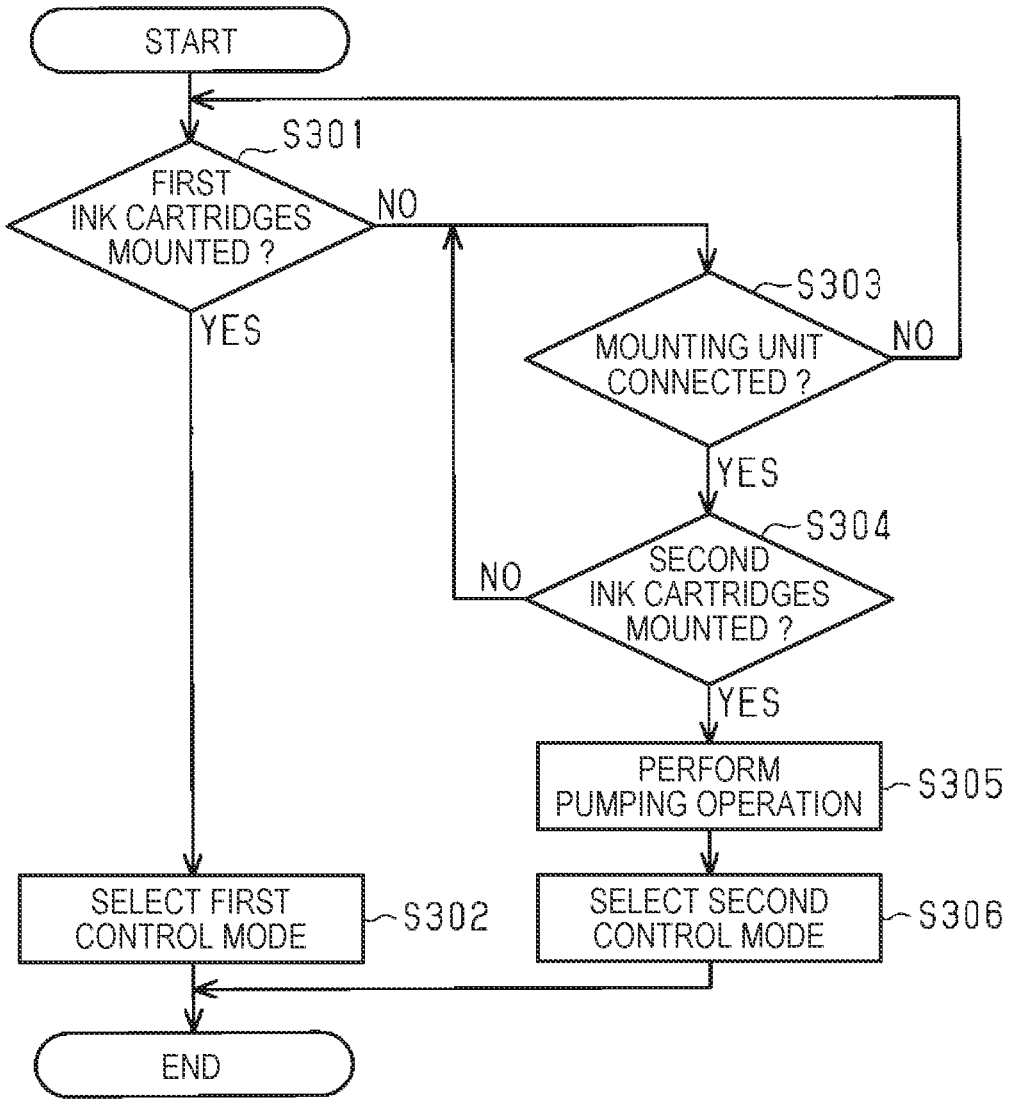
FIG. 9 is a flowchart showing a mode selection routine.

As shown in FIG. 9, in step S301, the control circuit portion 29 determines whether or not the first ink cartridges 16 are mounted in the mounting portion 63. If all first ink cartridges 16 are mounted in the mounting portion 63 (step S301: YES), in step S302, the control circuit portion 29 selects a first control mode, and ends the mode selection routine.

On the other hand, in step S301, if at least one first ink cartridge 16 is not mounted in the mounting portion 63 (step S301: NO), in step S303, the control circuit portion 29 determines whether or not the mounting unit 66 is mounted in the mounting portion 63. If the mounting unit 66 is not mounted in the mounting portion 63 (step S303: NO), the control circuit portion 29 shifts the procedure to step S301.

If the mounting unit 66 is mounted in the mounting portion 63 (step S303: YES), in step S304, the control circuit portion 29 determines whether or not all second ink cartridges 38 are mounted to the connection portion 41. If all second ink cartridges 38 are not mounted to the connection portion 41 (step S304: NO), the control circuit portion 29 shifts the procedure to step S303.

If all second ink cartridges 38 are mounted to the connection portion 41 (step S304: YES), in step S305, the control circuit portion 29 drives the pump 70 to perform a pumping operation. That is to say, the pump 70 sucks ink from the second ink cartridge 38 and thus ink can be supplied to the connection portion 41, the supply tube 69, the mounting member 68, and the print head 64. Subsequently, in step S306, the control circuit portion 29 selects a second control mode, and ends the mode selection routine. The control modes selected in steps S302 and S306 are stored in a non-volatile storage portion (not shown), and are maintained even after the power is turned off.

Next, the actions performed when mounting the first ink cartridge 16 in the printing apparatus 61 and when mounting the mounting unit 66 therein will be described. Note that the control in the first control mode and the second control mode in this embodiment is the same as the control in the first embodiment, and, thus, a description thereof has been omitted.

When mounting the first ink cartridge 16 in the mounting portion 63, the first ink cartridge 16 is mounted in the mounting portion 63, in a state where the first openable portion 25 is positioned at the open position B1. Thereafter, the first openable portion 25 is moved by the user to the closed position A1. Then, when the first ink cartridge 16 is mounted in the mounting portion 63, the control circuit portion 29 receives a signal indicating that the first ink cartridge 16 is mounted in the mounting portion 63, from the first circuit portion 32, and performs the control in the first control mode.

On the other hand, when mounting the mounting unit 66 in the mounting portion 63, the mounting unit 66 is mounted in the mounting portion 63, in a state where the first openable portion 25 is positioned at the open position B1. That is to say, the mounting member 68 included in the mounting unit 66 is mounted in the mounting portion 63. Furthermore, in the mounting unit 66, the second ink cartridge 38 is mounted to the connection portion 41, in a state where the second openable portion 43 is positioned at the open position B2. Thereafter, while the first openable portion 25 is kept at the open position B1, the second openable portion is moved by the user to the closed position A2.

Then, if the control circuit portion 29 receives a signal indicating that the mounting unit 66 is mounted in the mounting portion 63, from the first circuit portion 32, and receives a signal indicating that the second ink cartridge 38 is mounted in the mounting unit 66, from the second circuit portion 52, the control circuit portion 29 performs the control in the second control mode.

According to the second embodiment described above, the following effect can be obtained in addition to the effects (1) to (9) of the first embodiment.

(10) Since the pump 70 for supplying ink from the second ink cartridge 38 to the printing apparatus 11 is provided, ink can be supplied to the printing apparatus 11, regardless of the configuration of the printing apparatus 11.

Note that the foregoing embodiments may be changed as follows.

In the foregoing embodiments, the first mounting detection portion 30 may detect that the first ink cartridge 16 is mounted in the mounting portion 17 or 63, based on the signal received from the first open/closed detection portion 26 (a first modified example). That is to say, for example, the first ink cartridge 16 is mounted in the mounting portion 17 or 63 in a state where the first openable portion 25 is positioned at the open position B1, and the first openable portion 25 is moved to the closed position A1 after the first ink cartridge 16 is mounted. Accordingly, if the first open/closed detection portion 26 detects that the first openable portion 25 has moved from the open position B1 to the closed position A1, this detection may be taken as the detection that the first ink cartridge 16 is mounted in the mounting portion 17 or 63.

With this first modified example, the first mounting detection portion 30 causes the first open/closed detection portion 26 to detect whether the first openable portion 25 that is opened and closed when attaching or detaching the first ink cartridge 16 to or from the mounting portion 17 or 63 is open or closed. Accordingly, it is possible to easily detect that the first ink cartridge 16 is mounted in the mounting portion 17 or 63.

In the foregoing embodiments, the first mounting detection portion 30 may detect that the second ink cartridge 38 is mounted in the mounting unit 37 or 66, based on the signal received from the second open/closed detection portion 44 (a second modified example). That is to say, for example, the second ink cartridge 38 is mounted in the mounting unit 37 or 66 in a state where the second openable portion 43 is positioned at the open position B2, and the second openable portion 43 is moved to the closed position A2 after the second ink cartridge 38 is mounted. Accordingly, if the second open/closed detection portion 44 detects that the second openable portion 43 has moved from the open position B2 to the closed position A2, this detection may be taken as the detection that the second ink cartridge 38 is mounted in the mounting unit 37 or 66. Furthermore, in the case of detecting that the second ink cartridge 38 is mounted based on the detection result of the second open/closed detection portion 44, the mounting unit 37 or 66 may not include the second electrical connection portion 51.

With this second modified example, the second open/closed detection portion 44 detects whether the second openable portion 43 that is opened and closed when attaching or detaching the second ink cartridge 38 to or from the mounting unit 37 or 66 is open or closed. Accordingly, it is possible to easily detect that the second ink cartridge 38 is mounted in the mounting unit 37 or 66.

In the foregoing embodiments, the printing apparatus 11 or 61 may not include the first openable portion 25. That is to say, the first ink cartridge 16 may be mounted in the mounting portion 17 or 63 in a state of being exposed to the outside.

In the foregoing embodiments, the mounting unit 37 or 66 may not include the second openable portion 43. That is to say, it is possible that the second ink cartridge 38 cannot be attached or detached to or from the mounting portion 17 or 63. Furthermore, the second openable portion 43 may not be provided, and the second ink cartridge 38 may be accommodated in the cartridge accommodation portion 40 in a state of being exposed to the outside. Furthermore, the second ink cartridge 38 may be merely connected to the connection portion 41. That is to say, the mounting unit 37 or 66 may not include the cartridge accommodation portion 40. Furthermore, the second ink cartridge 38 may be a cartridge having a liquid injection opening (liquid receiving port) through which ink can be supplied.

In the foregoing embodiments, the first openable portion 25 and the second openable portion 43 may take any form as long as they can cover the opening portions and can be moved to expose the opening portions. For example, these openable portions may be slidable, folding, accordion-like, or roll-up curtain (shutter)-like portions. Furthermore, the first openable portion 25 and the second openable portion 43 do not have to completely cover the first ink cartridge 16 and the second ink cartridge 38, and it is sufficient that these openable portions are moved or deflected when attaching or detaching the first ink cartridge 16 or the second ink cartridge 38.

In the foregoing embodiments, the number of second ink cartridges 38 that can be mounted in the mounting unit 37 or 66 may be different from the number of first ink cartridges 16 mounted in the mounting portion 17 or 63 of the printing apparatus 11 or 61. That is to say, for example, the mounting unit may correspond to one supply needle 19, and the first ink cartridges 16 may be mounted in the positions corresponding to the supply needles 19 other than the supply needle 19 inserted into the mounting unit 37 or 66. If the mounting unit 37 or 66 and the first ink cartridges 16 are mounted, the first residual amount display portions 58*a* and the second residual amount display portion 58*b* may be displayed side by side. That is to say, the display device 58 may perform display such that the residual amounts of color ink contained in the first ink cartridges 16 are displayed in the first residual amount display portions 58*a*, and the residual amount of color ink corresponding to the second ink cartridge 38 is displayed in the second residual amount display portion 58*b*.

In the first embodiment described above, the printing apparatus 11 may include a plurality of mounting portions 17, where the mounting unit 37 may be mounted in at least one mounting portion 17, and the first ink cartridges 16 may be mounted in the other mounting portions 17.

In the second embodiment described above, the number of mounting members 68 may be larger than the number of first ink cartridges 16 that can be mounted in the mounting portion 63. In this case, only the number of mounting members 68 that can be mounted in the mounting portion 63 are mounted in the mounting portion 63. Furthermore, the mounting member 68 may have an outer shape obtained by coupling a plurality of first ink cartridges 16, and a plurality of supply needles 19 may be inserted into one mounting member 68.

In the foregoing embodiments, the number of second ink cartridges 38 that can be mounted in the mounting unit 37 or 66 may be smaller than the number of first ink cartridges 16 that can be mounted in the printing apparatus 11 or 61 (e.g., may be one). That is to say, it is possible that a plurality of mounting units 37 or 66 can be connected to the printing apparatus 11 or 61.

In the first embodiment described above, the mounting unit 37 may include the pump 70. That is to say, for example, the printing apparatus 11 may not include the supply pump 18, and ink may be supplied from the second ink cartridge 38 by the application of pressure from the pump 70 provided in the mounting unit 37.

In the foregoing embodiments, the printing apparatus 11 may not include the supply pump 18. Furthermore, the mounting unit 66 may not include the pump 70. For example, the second ink cartridge 38 may be provided at a position higher than the printing portion 13 in the vertical direction, so that ink is supplied due to a difference in the hydraulic head. Furthermore, the second ink cartridge 38 may be a flexible container, and a supply mechanism that supplies ink contained in this container by squeezing the container may be provided.

In the foregoing embodiments, the mounting unit 37 or 66 may not include the second circuit portion 52. For example, the information transmitted from the second chip 55 may be directly received by the first circuit portion 32.

In the foregoing embodiments, the control circuit portion 29 and the first connection terminal 33 may be directly electrically connected to each other. That is to say, the control circuit portion 29 and the second circuit portion 52 may be electrically connected to each other without involving the first circuit portion 32.

In the foregoing embodiments, the residual amount display portions displayed on the display device 58 may not be changed between the case in which the first ink cartridge 16 is mounted in the mounting portion 17 or 63 and the case in which the mounting unit 37 or 66 is mounted.

In the foregoing embodiments, the control modes may not be changed between the case in which the first ink cartridge 16 is mounted in the mounting portion 17 or 63 and the case in which the mounting unit 37 or 66 is mounted.

In the foregoing embodiments, the control circuit portion 29 may perform the control that displays the first residual amount display portions 58*a* and the second residual amount display portions 58*b* on the display device 58, with no relation to the control modes. That is to say, for example, if the first ink cartridge 16 is mounted in the mounting portion 17 or 63, the control circuit portion 29 may display the first residual amount display portion(s) 58*a* on the display device 58, without performing the settings of the control modes.

In the foregoing embodiments, the first residual amount display portions 58*a* displayed on the display device 58 in the first control mode may be shorter than and be as wide as the second residual amount display portions 58*b* displayed on the display device 58 in the second control mode. Furthermore, the first residual amount display portions 58*a* may be as long as and be narrower than the second residual amount display portions 58*b*.

In the foregoing embodiments, the first ink residual amounts and the second ink residual amounts may be detected by a sensor. For example, a photoelectric sensor having a light-emitting element and a light-receiving element may detect the ink residual amount based on the intensity of reflected light that changes in accordance with the residual amount of ink contained in the first ink cartridge 16 or the second ink cartridge 38. Furthermore, a sensor that detects a displacement member that is displaced in accordance with the consumption of ink, such as a float or a diaphragm, may be used to detect the ink residual amount.

In the foregoing embodiments, the cleaning performed for eliminating ink that has thickened and the like from the nozzles 12 may be different between the first control mode and the second control mode.

In the foregoing embodiments, the printing apparatus 11 or 61 may be a monochrome printing apparatus having the mounting portion 17 in which one type of first ink cartridge 16 can be mounted.

In the foregoing embodiments, the mounting unit 37 or 66 may wirelessly transmit a signal indicating that the second ink cartridge 38 is mounted. For example, the information may be transmitted through radio waves, light, or the like.

In the foregoing embodiments, the first mounting detection portion 30 may not include the first electrical connection portion 31. For example, the mounting portion 17 may be provided with a plurality of switches, and the first ink cartridge 16 and the mounting unit 37 or 66 may be provided with selector portions that select respectively different switches. That is to say, what is mounted in the mounting portion 17 or 63 may be detected based on the state of the switches when the first ink cartridge 16 is mounted in the mounting portion 17 and the state of the switches when the mounting unit 37 or 66 is mounted in the mounting portion 17. Furthermore, the printing apparatus 11 or 61 may use a non-contact sensor to detect the mounting unit 37 or 66. For example, marks or shapes provided on the mounting unit 37 or 66 may be detected using an image sensor.

The ink may be freely selected as long as it can be used for printing onto the medium P by being attached to the medium P. For example, the ink may be ink in which a solvent contains dissolved, dispersed, or mixed particles of a functional material made of a solid, such as pigments or metal particles, and may be various compositions such as water-based ink, oil-based ink, gel ink, hot melt ink, or the like.

The medium P may be a sheet, resin film, a resin sheet, composite film of paper and resin (resin-impregnated paper, resin-coated paper, etc.), metal foil, a metal plate, metal film, composite film of resin and metal (laminated film), woven fabric, nonwoven fabric, a ceramic sheet, a disc, or the like.

The inkjet printing apparatus 11 or 61 is an apparatus that prints images of characters, pictures, photos, or the like, by causing liquid to be attached to the medium P, and may be a serial printer, a lateral-type printer, a line printer, a page printer, or the like. Furthermore, the printing apparatus may be a textile printing apparatus that performs printing on fabrics by ejecting ink thereonto, for example. It is sufficient that the printing apparatuses have at least a printing function of performing printing on the medium P, and they may be a multi-function peripheral also having functions other than the printing function. Furthermore, the printing apparatuses may be an apparatus that performs printing not only on two-dimensional media but also three-dimensional media having curved faces.

What is claimed is:

1. An inkjet printing apparatus, comprising:

an ink cartridge mounting portion, adapted and configured to receive therein for mounting, either a first ink cartridge or an ink cartridge mounting unit, which itself is configured to receive a second ink cartridge, but not both; and a mounting detection portion that can detect whether the first ink cartridge or the ink cartridge mounting unit is mounted in the ink cartridge mounting portion; wherein the ink cartridge mounting portion is configured to be connected to the second ink cartridge when the mounting detection portion detects the ink cartridge mounting unit with the second ink cartridge mounted in the ink cartridge mounting unit.

2. The inkjet printing apparatus according to claim 1, wherein the mounting detection portion is adapted to be electrically connected to the ink cartridge mounting unit when the ink cartridge mounting unit is mounted in the ink cartridge mounting portion and the ink cartridge mounting unit is adapted to transmit a signal to the mounting detection portion indicating that the second ink cartridge is mounted therein; and the mounting detection portion is adapted, such that by receiving, from the ink cartridge mounting unit mounted in the ink cartridge mounting portion, the signal indicating that the second ink cartridge is mounted in the ink cartridge mounting unit, the mounting detection portion can detect that the second ink cartridge is mounted in the ink cartridge mounting unit.

3. The inkjet printing apparatus according to claim 1, wherein the second ink cartridge comprises a terminal contact portion and the ink cartridge mounting unit comprises an electrical connection portion and the mounting detection portion is adapted to be electrically connected to the electrical connection portion, and adapted to detect that the second ink cartridge is mounted in the ink cartridge mounting unit when the terminal contact portion is brought into contact with the electrical connection portion.

4. The inkjet printing apparatus according to claim 1, wherein the ink cartridge mounting portion includes:

an openable portion that is opened to receive or remove the first ink cartridge when attaching or detaching the first ink cartridge to or from the ink cartridge mounting portion and then closed during use of the printing apparatus; and an open/closed detection portion that detects whether the openable portion is open or closed and transmits a signal to the mounting detection portion, and the mounting detection portion is adapted to detect that the first ink cartridge is mounted in the ink cartridge mounting portion, based on a signal received from the open/closed detection portion.

5. The inkjet printing apparatus according to claim 1, wherein the mounting detection portion is adapted to detect that the second ink cartridge is mounted in the ink cartridge mounting unit, based on a signal received from an open/closed detection portion that detects whether an openable portion that is opened and closed when attaching or detaching the second ink cartridge to or from the ink cartridge mounting unit is open or closed.

6. The inkjet printing apparatus according to claim 1, further comprising a control circuit portion that switches control modes, wherein the mounting detection portion further includes a first circuit portion and a second circuit portion, adapted to transmit a signal indicating whether the first ink cartridge or the ink cartridge mounting unit with the second ink cartridge therein is mounted in the ink cartridge mounting portion, the control circuit portion performs control in a first control mode in a case of receiving a signal indicating that the first ink cartridge is mounted in the ink cartridge mounting portion, from the first circuit portion, and performs control in a second control mode in a case of receiving a signal indicating that the ink cartridge mounting unit is mounted in the ink cartridge mounting portion, from the first circuit portion, and receiving a signal indicating that the second ink cartridge is mounted in the ink cartridge mounting unit, from the second circuit portion included in the ink cartridge mounting unit.

7. The inkjet printing apparatus according to claim 1, further comprising:

a display device that is adapted to display an ink residual amount from either the first ink cartridge or the second ink cartridge; and a control circuit portion that controls display on the display device, wherein the mounting detection portion further includes a first circuit portion and a second circuit portion that transmits a signal indicating whether the first ink cartridge or the second ink cartridge is mounted in the ink cartridge mounting portion, the control circuit portion displays a first residual amount display portion on the display device in a case of receiving a signal indicating that the first ink cartridge is mounted in the ink cartridge mounting portion, from the first circuit portion, and displays a second residual amount display portion on the display device in a case of receiving a signal indicating that the ink cartridge mounting unit is mounted in the ink cartridge mounting portion, from the first circuit portion, and receiving a signal indicating that the second ink cartridge is mounted in the ink cartridge mounting unit, from a second circuit portion.

8. The inkjet printing apparatus according to claim 6, wherein the control circuit portion can be connected via the first circuit portion to the second circuit portion in a case where the ink cartridge mounting unit is mounted in the ink cartridge mounting portion.

9. An ink cartridge mounting unit adapted to be mounted to an ink cartridge receiving portion of an inkjet apparatus, in which a first ink cartridge can be mounted, the ink cartridge mounting unit adapted and configured such that a second ink cartridge can be mounted therein and such that it can be connected to an inkjet printing apparatus at the location where a first ink cartridge can be mounted to the inkjet apparatus, the ink cartridge mounting unit comprising a terminal contact portion that can transmit identification information regarding the second ink cartridge that is mounted therein, when connected to an electrical connection portion provided in the inkjet printing apparatus.

10. The ink cartridge mounting unit according to claim 9, further comprising a circuit portion that can transmit a signal to a control circuit portion provided in the inkjet printing apparatus when the first ink cartridge is mounted in the ink cartridge mounting unit.

11. The ink cartridge mounting unit according to claim 9, further comprising:

a cartridge accommodation portion that can accommodate the second ink cartridge; and an openable portion that is opened when attaching or detaching the second ink cartridge to or from the cartridge accommodation portion and then closed prior to use.

12. The ink cartridge mounting unit according to claim 9, further comprising a pump for supplying ink from the second ink cartridge to the inkjet printing apparatus.

* * * * *